US006402609B1

(12) United States Patent
Mangia

(10) Patent No.: US 6,402,609 B1
(45) Date of Patent: Jun. 11, 2002

(54) SEAL VENT

(76) Inventor: Neil Mangia, 20361 Prairie St., Chatsworth, CA (US) 91311

( * ) Notice: Subject to any disclaimer, the term of this patent is extended or adjusted under 35 U.S.C. 154(b) by 0 days.

(21) Appl. No.: 09/918,775

(22) Filed: Jul. 31, 2001

(51) Int. Cl.[7] ..... F24F 7/06

(52) U.S. Cl. ..... 454/18; 454/30; 454/347; 454/363

(58) Field of Search ..... 454/7, 18, 19, 454/30, 347, 349, 363

(56) References Cited

U.S. PATENT DOCUMENTS

| | | | | |
|---|---|---|---|---|
| 1,663,199 A | | 3/1928 | Hirschman | |
| 1,952,707 A | | 3/1934 | Germonprez | |
| 2,246,602 A | | 6/1941 | Schultz et al. | |
| 2,642,270 A | | 6/1953 | Hollingsworth et al. | |
| 2,790,372 A | | 4/1957 | Cooper | |
| 3,605,797 A | * | 9/1971 | Dieckmann et al. | 137/375 |
| 4,416,415 A | | 11/1983 | Kolt | |
| 4,867,047 A | * | 9/1989 | Citron | 126/286 |
| 5,183,435 A | * | 2/1993 | Galvez | 454/18 |
| 5,588,911 A | | 12/1996 | Gomez | |
| 5,702,298 A | | 12/1997 | Conkling | |

FOREIGN PATENT DOCUMENTS

| | | | | |
|---|---|---|---|---|
| DE | 2 249 702 | * | 4/1974 | 454/347 |

* cited by examiner

*Primary Examiner*—Harold Joyce
(74) *Attorney, Agent, or Firm*—Sanford Astor

(57) ABSTRACT

A damper for an air turbine mounted on the roof of a house, or other structure, comprising a tube adapted to fit into the opening below the turbine, a cover hingedly attached to the tube, a cable attached to the cover adapted to be pulled out to close the cover or pushed in to open the cover. The damper is attached to the turbine by clips which attach to a flange of the turbine or by brackets affixed to the roof.

14 Claims, 6 Drawing Sheets

SEAL VENT

BACKGROUND OF THE INVENTION

1. Field of the Invention

This invention relates to air turbines installed on a roof to vent hot air. Air turbines are designed to spin freely in the wind, exiting hot air from attics. In the winter, when the temperature has dropped, warm air is still exhausted from the house, or other structure, through the air turbine. Most people leave the turbines open year round, wasting fuel and money or they climb on the roof and tie a plastic bag over the turbine, which is dangerous. This invention solves the problem, saving heating and cooling costs.

2. Prior Art

Several patents have described complicated and expensive methods for closing an air tubine when it is desired to shut off the flow of air therethrough. These methods are so expensive and complicated that most homeowners will simply tie a plastic bag around the turbine on the roof to close off the air flow.

For instance in Kolt's U.S. Pat. No. 4,416,415, there is described an automatic temperature and pressure responsive damper assembly. Kolt's assembly requires a temperature detection device and a temperature responsive drive assembly. Power is required to operate the device.

Hirschman, in U.S. Pat. No. 1,663,199, uses a plurality of louvers or shutters adapted to be swung into a horizontal position in which they overlap and engage each other, page 4, lines 39–45. This requires pivotal bearings on each shutter, page 4, lines 60–61, filling blocks on the supporting ring, pivot pins and grooved edges on the shutters, Page 4 lines 73–95. This is a very complex system and expensive to manufacture.

To utilize the systems of Kolt or Hirschman, one would have to remove the exisiting turbines and completely replace them with the new turbines.

SUMMARY OF THE INVENTION

Applicant's invention comprises a damper device that works as a valve to eliminate air flow from turbines presently installed on any roof. The existing turbines may be left in place, reducing the cost tremendously.

The device of this invention comprises a push-pull remote mounted cable that controls a damper cover or flap, adapted to open or close air access between the turbine and the structure on which it is mounted. The seal vent of this invention clips onto the existing turbine. The cover flap is adjustable to any position between all the way open and all the way closed. It may be added to any existing turbine on any roof.

OBJECTS OF THE INVENTION

Accordingly, several objects and advantages of the invention are as follows:

It is an object of the present invention to provide a system to open and close the airflow from a roof mounted turbine.

Another object of the invention is to provide such a device which may be added to any exising turbine now installed on any roof on any structure.

Yet another object of the invention is to provide such a device which is easy to install, easy. to operate and inexpensive to produce.

DETAILED DESCRIPTION OF THE INVENTION

Figure 1:
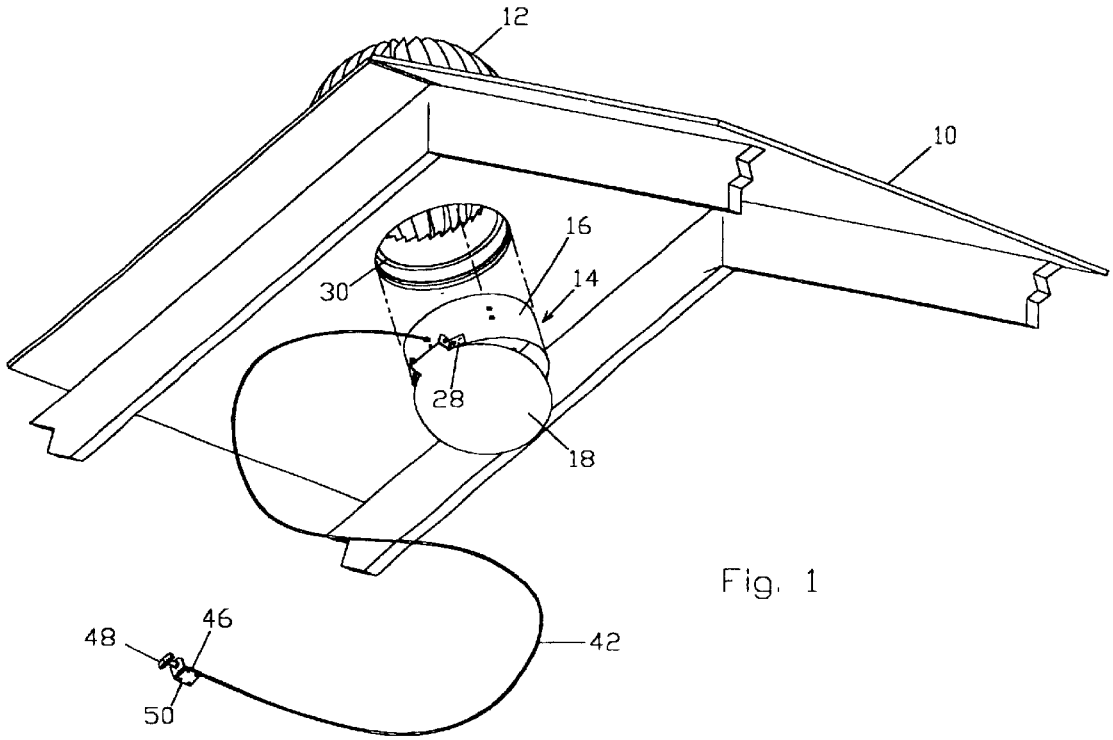
FIG. 1 is a perspective view of the turbine damper device of this invention, viewed from the bottom.
Figure 2:
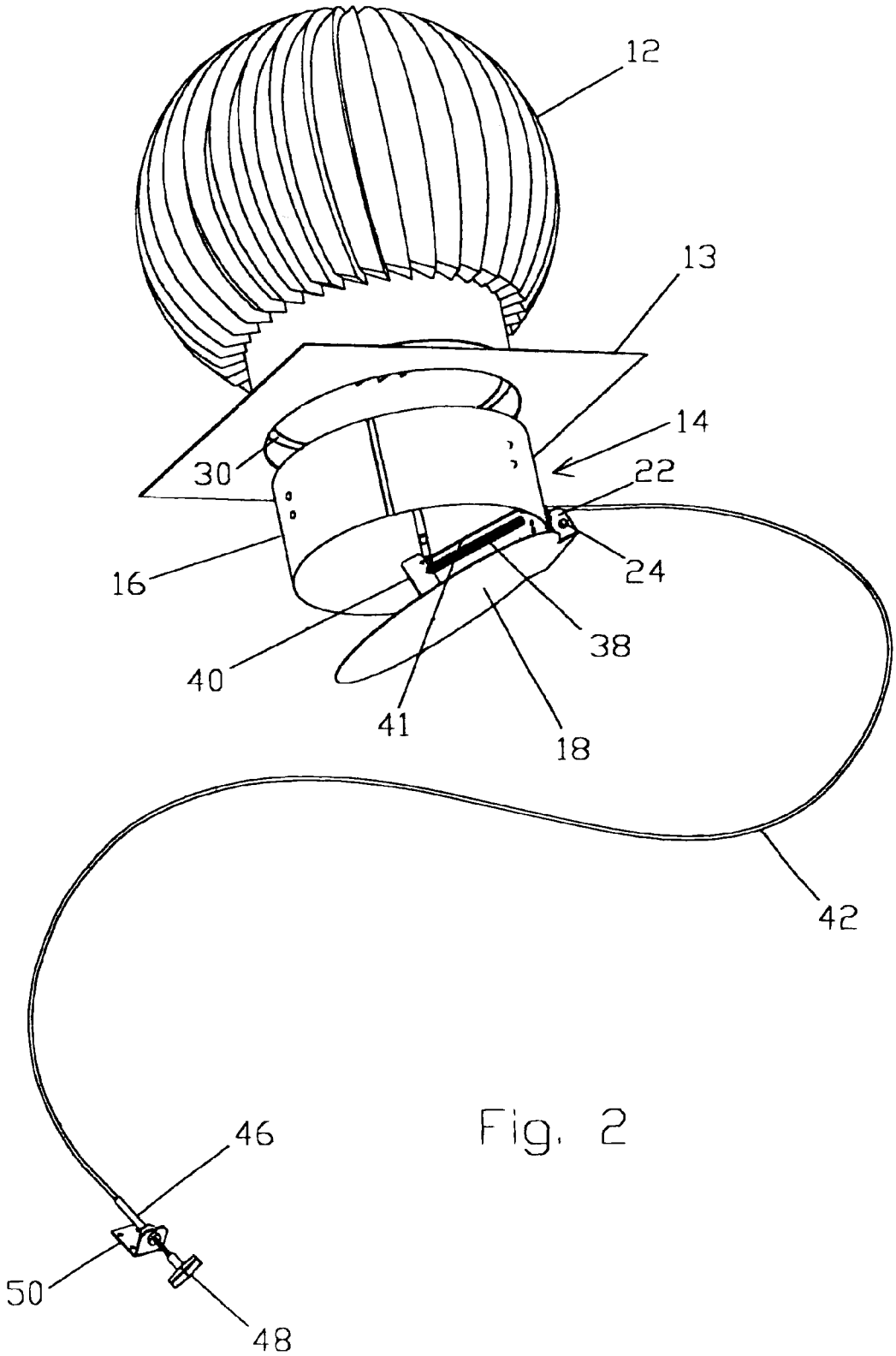
FIG. 2 is a perspective view from the bottom, adjacent a turbine.

Referring now to the drawings, there is shown a roof 10 of any structure. A standard turbine 12 is fixedly attached to roof 10. Turbine 12 has a mounting base 13. The damper device 14 of this invention comprises a tube 16 to which a cover or flap 18 is hingedly attached. A rod 20 is rotatably mounted on a supporting bracket 22. A rod cap 24, with another on the other end of rod 20, holds rod 20 in place in bracket 22. Cover 18 is fixedly attached to bracket 22. Tube 16 is approximately the same diameter as the opening below turbine 12, so that it may be pushed up into the opening and be attached to turbine 12.

Figure 3:
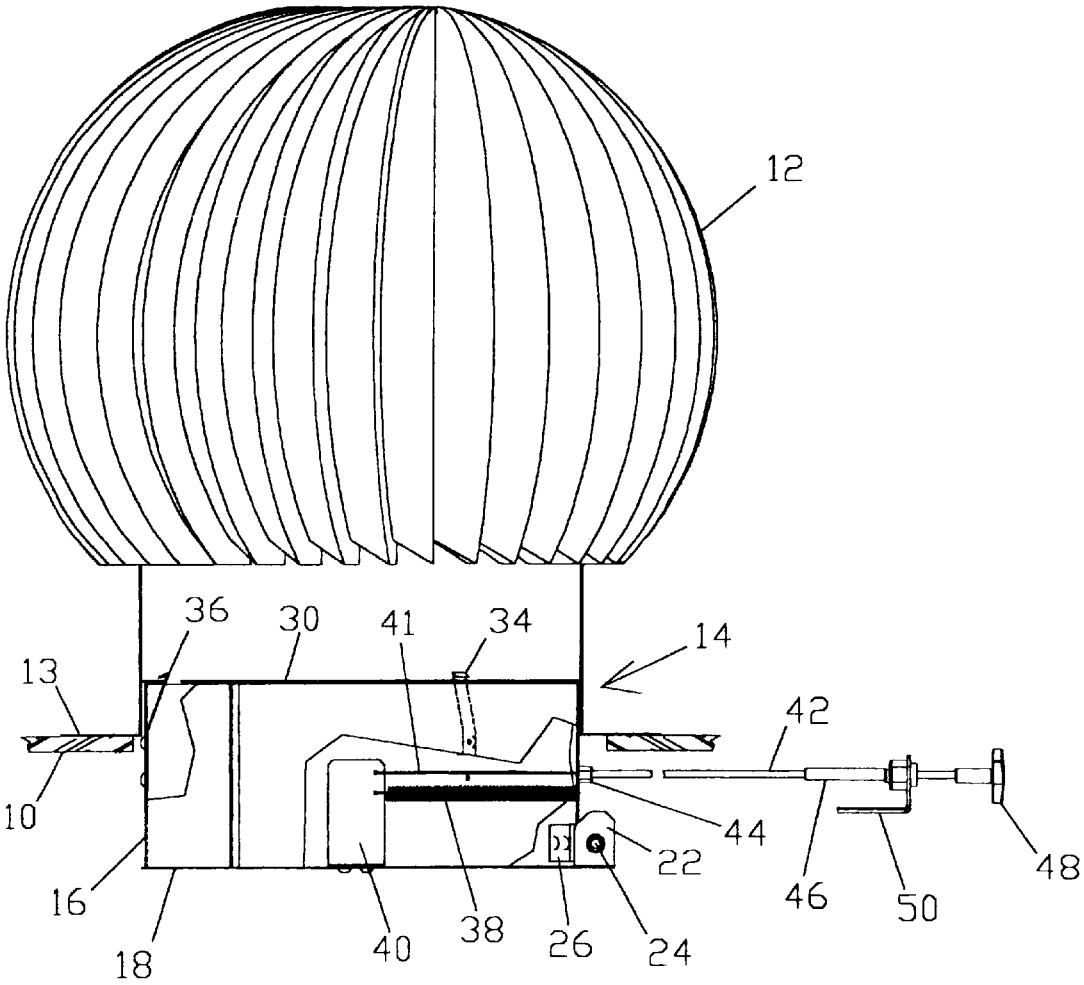
FIG. 3 is a side view, partially broken away.
Figure 4:
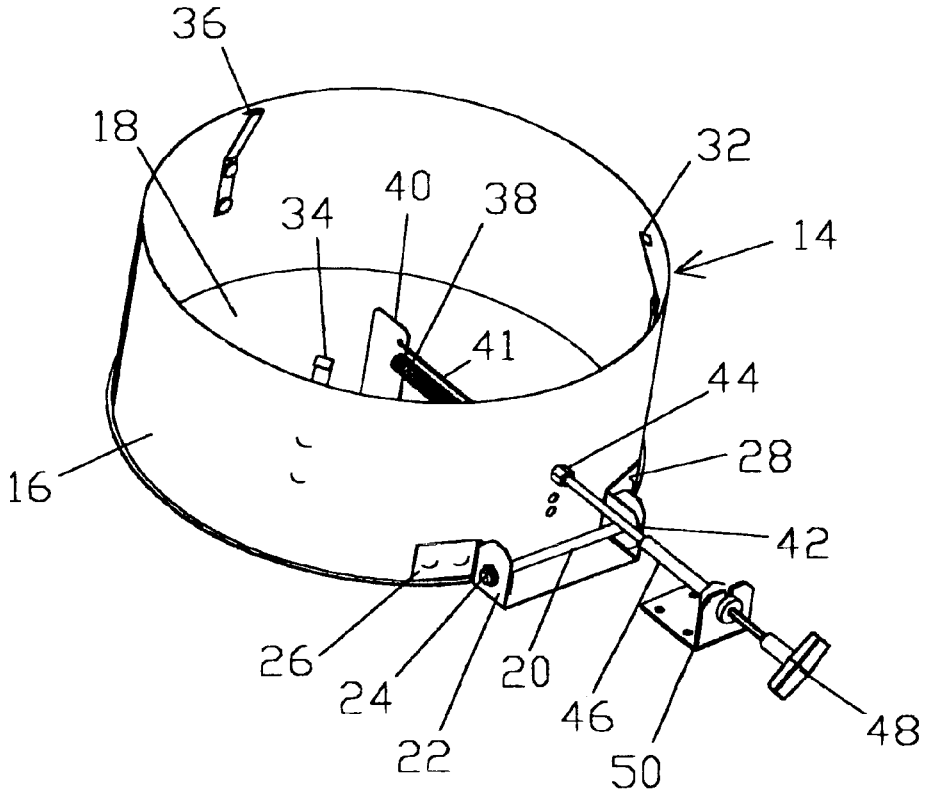
FIG. 4 is a perspective top view.
Figure 5:
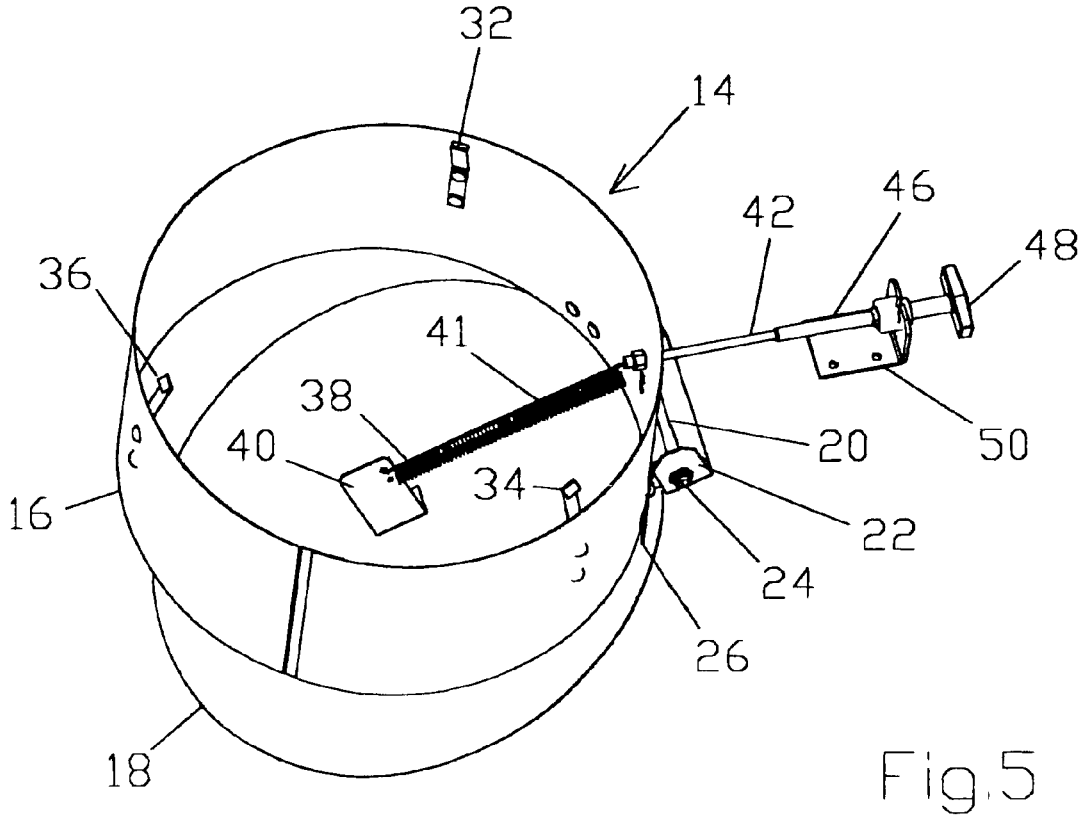
FIG. 5 is a perspective top view from another angle
Figure 6:
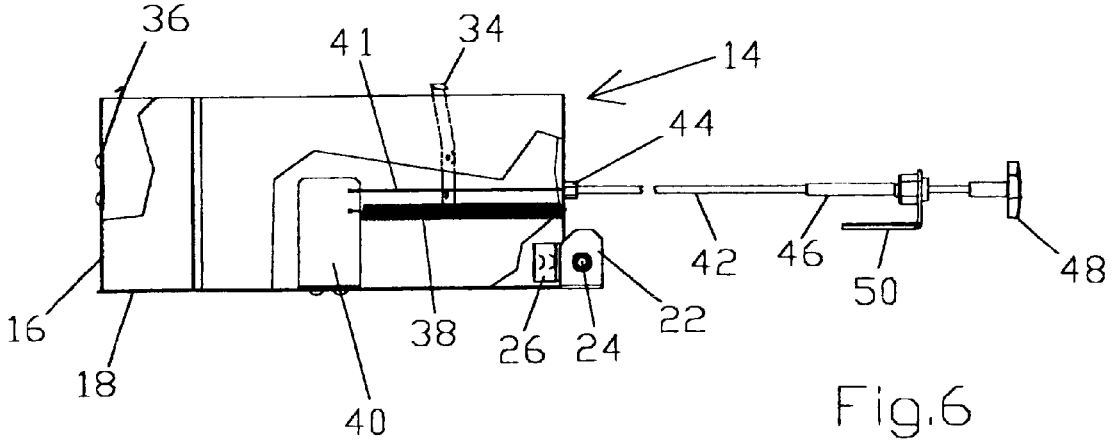
FIG. 6 is a side view in the closed position.
Figure 7:
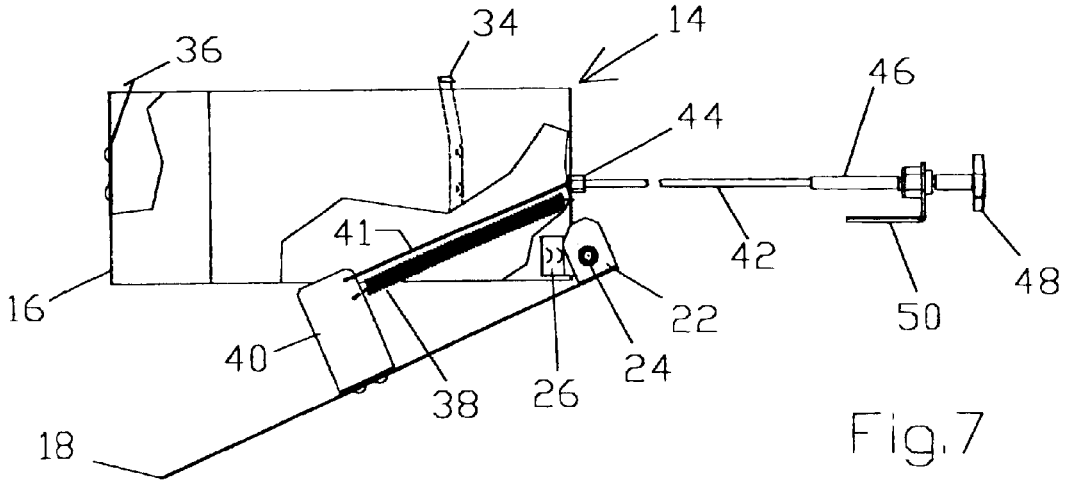
FIG. 7 is a side view in the open position.
Figure 8:
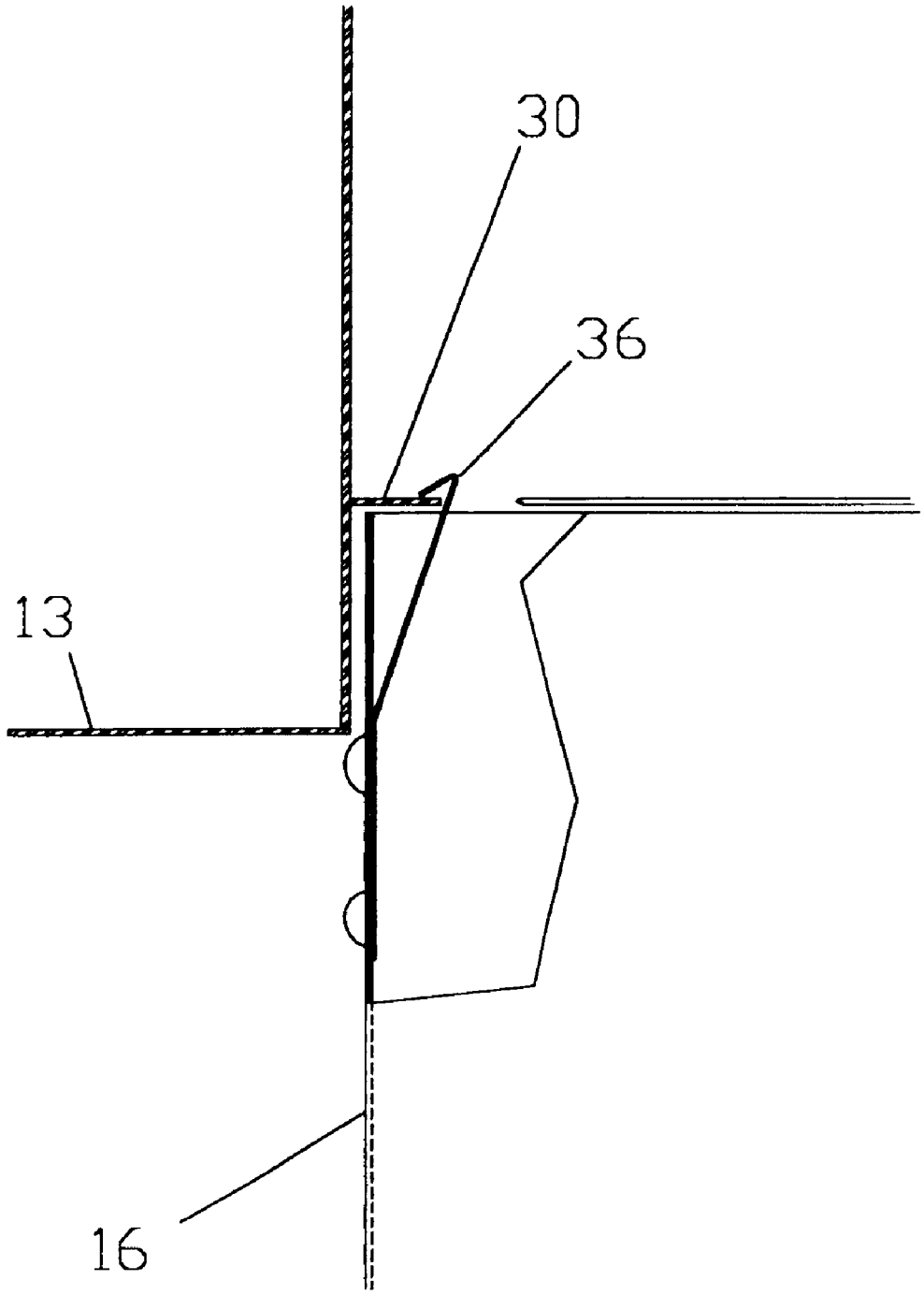
FIG. 8 is a side view of a connecting clip.

Bracket 22 is fixedly attached to tube 16 by attachment brackets 26 and 28, allowing cover 18,to rotate between a closed position (FIGS. 3, 4 and 6) and an open position (FIGS. 1, 2, 5, and 7).

Turbine 12 attached to roof 10 has flange 30. Flange 30 is present in nearly all such turbines. Damper 14 is easily attached to turbine 12 by a plurality of retaining clips 32, 34, and 36. Clips 32, 34 and 36 are biased outwardly, so that when tube 16 is pushed up into the space 38 under turbine 12, clips 32, 34 and 36 will snap onto flange 30 and hold damper 14 securely in place.

For those few turbines that do not have a flange, a plurality of 90 degree L-brackets may be used to attach damper 14 directly to roof 10 below turbine 12.

A spring 38 is held at one end by center bracket 40 attached to the top of cover 18. Spring 38 is. held at the other end by a hook, to the side of tube 16. A cable.41 is attached at one end to center bracket 40 and passes through a hole in tube 16 supported by cable support 44. When cable 41 exits tube 16 at cable support 44, it is now covered by cable sheath 42. As cable 41 moves in and out of tube 16, it is,protected by sheath 42.

At its other end, cable 41 is fixedly attached to control handle 48 which has mounting bracket 50 adapted to be fixedly attached to a wall, or other location inside the structure. A locking mechanism 46 allows control handle 48 to lock cable 41.

Cover 18 is opened and closed by releasing handle 48 from its locked position, by turning it, and then pushing it in to open cover 18 or pulling it out to close cover 18. Cable 41 and handle 48 comprise a standard product, such as a "push-pull" control distributed by Au-ve-co Products of Cincinnati, Ohio. When handle 48 is turned in one direction, such as clockwise, cable 41 is locked in place and cannot be moved. When handle 48 is turned in the other direction, such as counter-clockwise, cable 41 is released and can be pushed in or pulled out of locking mechanism 46. When pulled out, cable 41 pulls center bracket 40 up, closing cover 18. When cable 41 is pushed in, center bracket 40 is pushed down, opening cover 18. Spring 38 aids in the opening and closing of cover 18.

Because of the adjustability of cable 41, cover 18 may be left in any position between fully opened and fully closed.

In general operation, cover 18 will be opened fully in hot weather, allowing turbine 12 to remove hot air-from the structure on which it is installed. In colder weather, cover 18 is closed so that warm air inside the structure does not exit the structure through turbine 12.

Nearly all turbines installed today have no mechanism to block the exit of warm air. As stated, most homeowners in winter, go up on their roofs and tie a plastic bags over the turbines, to prevent the loss of warm air. This is dangerous, inneffective and a nuisance, particularly when the weather may change often in any given period of time. Applicant's device makes it possible to easily adjust the amount of airflow through the turbines whenever desired, from inside the house, or other structure.

The device of this invention, slips easily into place, may be installed by anyone and effectively adjusts the air flow, including closing it off completely when desired.

Having thus described the invention,

I claim:

1. A damper for an air turbine mounted on the roof of a structure, having an opening below the turbine into the structure, said damper comprising a tube adapted to fit into the opening below the turbine, a cover hingedly attached to the tube, a cable attached to the cover adapted to adjust the cover between an open and closed position, means to attach the tube to the turbine.

2. The device of claim 1 in which the means to attach the tube comprises a plurality of clips.

3. The device of claim 1 further comprising a handle at the end of the cable adapted to lock and unlock the movement of the cable.

4. The device of claim 1 further comprising a bracket affixed to the cover to which one end of the cable is attached.

5. The device of claim 4 further comprising a spring attached at one end to said bracket and at the other end to said tube.

6. The device of claim 3 further comprising a bracket attached to said handle for attachment of the handle to the structure.

7. The device of claim 1 in which the turbine has a flange and the damper is connected to the turbine by a plurality of clips attached to the flange.

8. The device of claim 1 in which the damper is attached to the roof below the turbine.

9. The device of claim 8 in which the damper is attached by L-brackets.

10. A damper for an air turbine mounted on the roof of a structure, having an opening below the turbine into the structure, said turbine having a flange, said damper comprising a tube adapted to fit into the opening below the turbine, a cover hingedly attached to the tube, a cable attached to the cover adapted to adjust the cover between an open and closed position, a plurality of clips attached to the tube to attach the tube to the flange of the turbine.

11. The device of claim 10 further comprising a handle at the end of the cable adapted to lock and unlock the movement of the cable.

12. The device of claim 10 further comprising a bracket affixed to the cover to which one end of the cable is attached.

13. The device of claim 10 further comprising a spring attached at one end to said bracket and at the other end to said tube.

14. The device of claim 10 further comprising a bracket attached to said handle for attachment of the handle to the structure.

* * * * *